United States Patent [19]

Moore

[11] 4,073,174

[45] * Feb. 14, 1978

[54] PROCESS OF FORGING LARGE SEAMLESS FERROUS-METAL WELDING NECKS AND OTHER CYLINDRICAL ARTICLES

[76] Inventor: Charles H. Moore, 645 Matanzas Court, Fort Myers Beach, Fla. 33931

[ * ] Notice: The portion of the term of this patent subsequent to Nov. 22, 1994, has been disclaimed.

[21] Appl. No.: 650,001

[22] Filed: Jan. 19, 1976

Related U.S. Application Data

[63] Continuation-in-part of Ser. No. 519,043, Oct. 29, 1974, abandoned.

[51] Int. Cl.[2] ..... B21C 23/00; B21C 23/01; B21C 23/20; B21C 35/04

[52] U.S. Cl. ..... 72/254; 72/267; 72/256; 72/353; 72/358; 72/368; 72/373

[58] Field of Search ..... 72/253, 254, 267, 264, 72/256, 353, 358, 361, 367, 368, 356, 370

[56] References Cited

U.S. PATENT DOCUMENTS

| | | | |
|---|---|---|---|
| 1,082,200 | 12/1913 | Knaebel | 72/267 X |
| 2,348,179 | 5/1944 | Moore | 72/327 |
| 2,679,931 | 6/1954 | Cigliano | 72/267 X |
| 2,810,478 | 10/1957 | Sejournet et al. | 72/358 X |

FOREIGN PATENT DOCUMENTS

| | | | |
|---|---|---|---|
| 351,814 | 8/1937 | Italy | 72/358 |
| 849,468 | 9/1960 | United Kingdom | 72/253 |

*Primary Examiner*—Lowell A. Larson
*Assistant Examiner*—D. M. Gurley

[57] ABSTRACT

Large, heavy-duty, seamless high-pressure resistant ferrous-metal welding necks and other substantially thick-walled cylindrical articles are forged in such manner as to obtain greatly improved quality, dimensionally, metallurgically and otherwise, by the use in sequence of a certain combination of metal-forging elements; which includes a vertically disposed cylindrical female forging die member provided at its bottom with a removable disc and a surrounding circular forging kinfe; an annular metal-working and metal-displacing ring having an external diameter which is slightly less than the bore of the cylindrical female forging die member; a metal-working and metal-displacing disc which interfits with the annular metal-working and metal-displacing ring; a first round forging press follower of a diameter which is adequate to entirely cover the metal-working and metal-displacing disc and a substantial portion of the annular metal-working and metal-displacing ring; a second round forging press follower of a diameter which is slightly less than the internal diameter of the annular metal-working and metal-displacing ring.

3 Claims, 8 Drawing Figures

THE INVENTION

ERRONEOUS PRIOR ART PRACTICE

THE INVENTION

THE INVENTION

PROCESS OF FORGING LARGE SEAMLESS FERROUS-METAL WELDING NECKS AND OTHER CYLINDRICAL ARTICLES

This is a continuation-in-part application of my pending application Ser. No. 519,043, filed Oct. 29, 1974, entitled "Process of Forging Large Seamless Welding Necks" (now abandoned); and it relates to my pending Continuation-in-part application filed Dec. 29, 1975 (based on Ser. No. 519,044, now abandoned) entitled "Process For Producing Cup-Shaped Ferrous Metal Products Having a Cylindrical Barrel".

The present invention relates to welding necks which are widely used on industrial pressure vessels, and particularly those which are of manhole size and have long barrels, for example a product of approximately 18 × 14, 300 lb. series, weighing approximately 1083 lbs. and much larger and heavier.

On most pressure vessels, where manhole size welding necks are used, there are no pipe connections from the bolt flanges of the manholes to various pipe lines. These large welding necks are truly a manhole, and each and every one of them requires a blind cover.

As indicated earlier herein, the present invention departs from the use of a conventional cylindrical female forging die member having an integrally formed flange and flange recess at one end for forming the annular bolt flange of the large size welding necks.

The cylindrical female forging die member of the present invention has no integrally formed flange and flange recess at one end and is utilized with a separate annular male forging die member; and the manner in which they are used, produces a number of objectives and advantages which are not otherwise obtained.

One of the very substantial advantages which are achieved by the practice of the process of the present invention is that a cylindrical female forging die element which is devoid of the usual integral annular male forging die flange and recess at one end may be used to acquire extra metal reinforcement with the desired male bolt flange applied thereto in a separate and final metal forging operation.

Another advantage which is obtained by the present invention is that fewer cylindrical female forging die members will be necessary to complete the forge shop inventory, because of the fact that the male bolt flange forging dies are entirely separate; and, therefor, many of these cylinders can be used with bolt flanges of various sizes.

Still another advantage is that the new process permits the forge shop to use a multitude of billets of various sizes both with and without rounded corners. This is very important since it permits the use of solid ferrous metal objects to be found in and around the forge shop which would otherwise be utilizable as scrap.

A further objective is to obtain more uniform extrusion and improved metallurgical properties than can be obtained by the use of the earlier methods.

A still further advantage is that the present process is so conducted that there is a substantial savings in the weight of the metal of the finished forging, i.e., in some instances almost as much as 50%, as will be further explained hereinafter.

The foregoing and other objects and advantages will be more readily understood from the following description and the annexed drawings, wherein like references represent like parts, and wherein:

FIG. 1 is a sectional elevation of a welding neck of the type to which the present invention is related, the same comprising an elongated cylindrical barrel with an integral annular flange at one end (which may or may not have a raised outer face R). Prior to installation, the integral annular flange is in conformity with prior art conventionally provided with suitable bolt-holes (not shown), whereby said annular flange may be tightly secured to a disc-shaped cover (blind flange) having corresponding bolt-holes.

In metal-working in general, and light-weight metal-working in particular, back-extrusion of the metal has been proposed for the manufacture of small rings and short sleeve-like articles for one purpose or another; such as piston rings, bearing races and the like; but to what extent, and with what degree of success, is not known.

One of the prior art methods includes back-extrusion to obtain an article having a cylindrical wall and wherein a heated billet is placed in a vertically disposed cylindrical die with a temporarily closed bottom and a round punch is moved downwardly on it until the height of the billet is decreased and the metal thereof is forced outwardly into full contact with the adjacent surfaces of the interior of the cylindrical forging die. A second round punch of smaller diameter than the first is then forced downwardly onto the top of the heated billet, causing the metal thereof to move upwardly between the periphery of the second round punch (of smaller diameter) and the circular sidewall of the cylindrical female forging die. This back-extrusion of the metal of the heated billet is accompanied by a strong tendency on the part of the cylindrical die to move upwardly therewith; and it is therefore essential that the cylindrical female forging die be strongly bolted down to the bed of the forging press or machine. Such hold-downs are very widely known in the heavy forging industry, including chains, bolting arrangements, pressure resisting arms from above; and as such form no part of the present invention.

Accordingly, the same are neither illustrated in the accompanying drawings nor referred to hereinafter.

The light-weight practices of the light-forging art earlier referred to are believed non-analogous to the present invention not only in the matter of industrial environment and vast differences in size etc.; but also due to a very important difference in the manner in which the metal itself is worked during the particular back-extrusion step, and the manner in which the billet or work-piece and the handling instrumentalities therefor are manipulated; all of which will be more fully described hereinafter.

Figure 1:
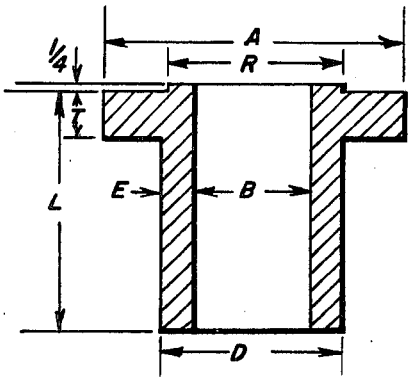
Figure 2:
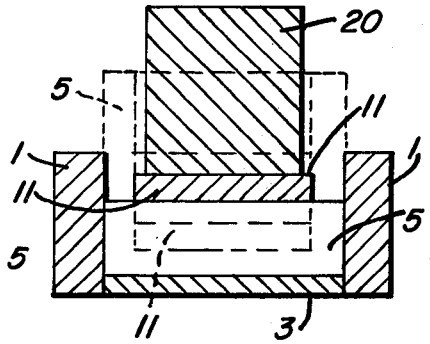
FIG. 2 is a sectional elevational view illustrating a number of concentrically disposed basic forging instrumentalities which are employed in prior art practices.
Figure 3:
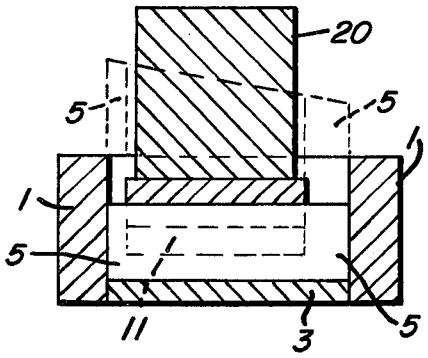
PRIOR ART FIG. 3
FIG. 3 is a sectional elevation illustrating a very undesirable situation which results from certain prior art practices which are avoided by the process of the present invention.
Figure 4:
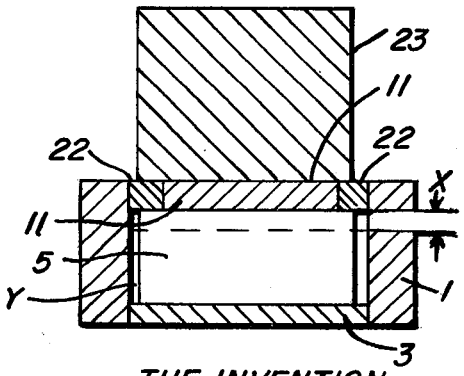
FIGS. 4, 5 and 6 are views which are similar in nature to that of FIG. 2, but wherein the work-piece is illustrated as being in certain positions during certain stages of the process of the invention wherein back-extrusion takes place, FIG. 6 illustrating a shearing step.

As indicated on the drawings, the shape of the product illustrated in FIG. 1 of the drawings is itself old in the art, as are the method steps illustrated in FIGS. 2 and 3. Accordingly, the process steps of the present invention which is of utmost importance actually commence with FIG. 4.

The numeral 1 designates the cylindrical female forging die element having a bore of predetermined length and diameter and a removable round bottom plate 3. As will be referred to later herein, a circular knife with a removable round block or disc positioned therewithin may be substituted for the removable bottom plate 3.

The work-piece 5 which is placed in the die cavity of the cylindrical female forging die member 1 is a billet of ferrous metal which may be square, square with rounded edges, or round, and heated to forging temperature; and which, according to the teachings of the invention, may be of considerably lesser diameter than the die cavity, as indicated at Y. This feature is very important, as will appear hereinafter.

Next, there is placed on top of the heated work-piece 5 an annular metal-working and metal-displacing ring 22 and a metal-working and metal-displacing disc 11.

The diameter of the metal-working and metal-displacing disc 11 is of lesser diameter than the inside diameter of the metal-working and metal-displacing ring 22; and the outside diameter of the latter is slightly less than the diameter of the bore of the cylindrical female forging die.

Both metal-working and metal-displacing disc 11 and metal-working and metal-displacing ring 22 are of substantial thickness in order to resist the high stresses to which they are exposed; for example, 3 inches or more.

This annular metal-working and metal-displacing ring 22 and the manner in which it is used are very important. Initially it serves to center the metal-working and metal-displacing disc 11 within the mold cavity, and thereafter it serves, along with the metal-working and metal-displacing disc, to perform the initial metal-working step of the process, as will shortly appear.

Disposed atop the annular ring 22 and the metal-working and metal-displacing disc 11 is a conventional round forging press follower 23 of a diameter which is less than the diameter of the bore or die cavity of the cylindrical female forging die member 1 but sufficient to cover both the annular metal-working and metal-displacing ring 22 and the metal-working and metal-displacing disc 11.

When the vertically movable upper member, or platen, of the forging press is moved downwardly, the round follower 23 which is of slightly less diameter than the diameter of the forging die cavity of the cylindrical female die member 1 exerts downward pressure on the metal-working and metal-displacing disc 11 and the annular metal-working and metal-displacing ring 22, the metal of the billet or work-piece spreads out until the outer periphery thereof finally makes contact with the surface of the side wall of the forging die cavity of the cylindrical female die element 1. At this point which is indicated at X in FIG. 4, the downward movement of these two metal-working and metal-displacing members is discontinued.

It is because of the metal-working and metal-displacing ring 22 that billets of smaller size may be utilized; and this results in increased economy.

At this point, the initial round forging press follower 23 is removed from the die cavity of the cylindrical female forging die member 1, and replaced by a second round forging press follower 24 having a diameter that is slightly less than the diameter of the metal-working and metal-displacing disc 11 and which is concentrically disposed with respect to the latter.

The pressure of the vertically movable member platen of the forging press is applied to the top of the second round forging press follower 24; and the metal between the inner wall of the cylindrical female forging die member 1 and the periphery of the metal-working and metal-displacing disc 11, which is concentric therewith, rises therebetween and pushes the annular metal--working and metal-displacing ring 22 upwardly as the top of the vertical backward extrusion rises.

The downward movement of the platen of the forging press is discontinued at that point where the metal at the bottom of the heated work-piece is of the desired thickness. This may widely vary, but for purpose of illustration, at least 3 inches of metal is left in the bottom.

The process of the present invention continues with the removal of the 3 inch thickness at the bottom of the cylindrical female forging die member 1 to produce a large size welding neck as will be described hereinafter.

Figure 6:
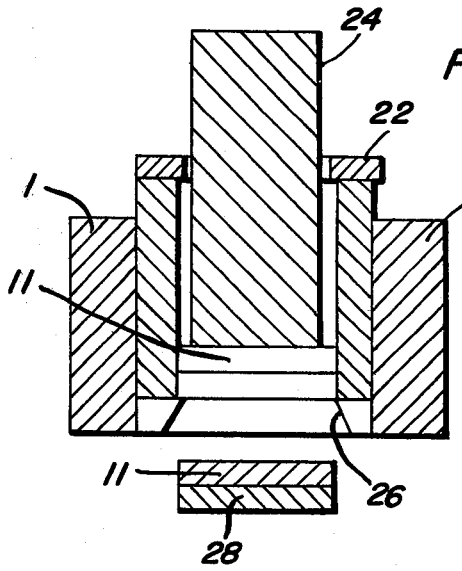

Accordingly, and as shown in FIG. 6, the cylindrical female forging die member 1 may be suitably raised and blocked-up, and the removable bottom or plate 3 removed and replaced by a circular knife indicated at 26.

With the aid of the platen of the forging press and the (second) follower 24 or a similar instrumentality, the metal-working and metal-displacing disc 11 and the three-inch thickness of metal 28 immediately therebelow are punched-out.

As mentioned earlier, the removable bottom closure 3 may, at the outset, be replaced by a circular knife and a removable and interfitting round block or disc; in which case it is only necessary that suitable space be provided beneath the cylindrical female forging die member 1 immediately preceding the punching-out step.

It may be that at this point the now-cylindrical work-pieces 5 will have lost sufficient heat to require reheating.

The cylindrical body obtained by the process described, or any other cylindrical body of acceptable quality, and heated to forging temperature, is placed in the die cavity of the cylindrical female forging die element 1 immediately after a circular knife is placed in the bottom thereof. In some situations it may be necessary, in order to assure sufficient metal for the formation at the top of the cylindrical female forging die member 1 of a male bolting flange of adequate width, to place upon the circular knife an annular ring (not shown) of appropriate height.

Figure 7:
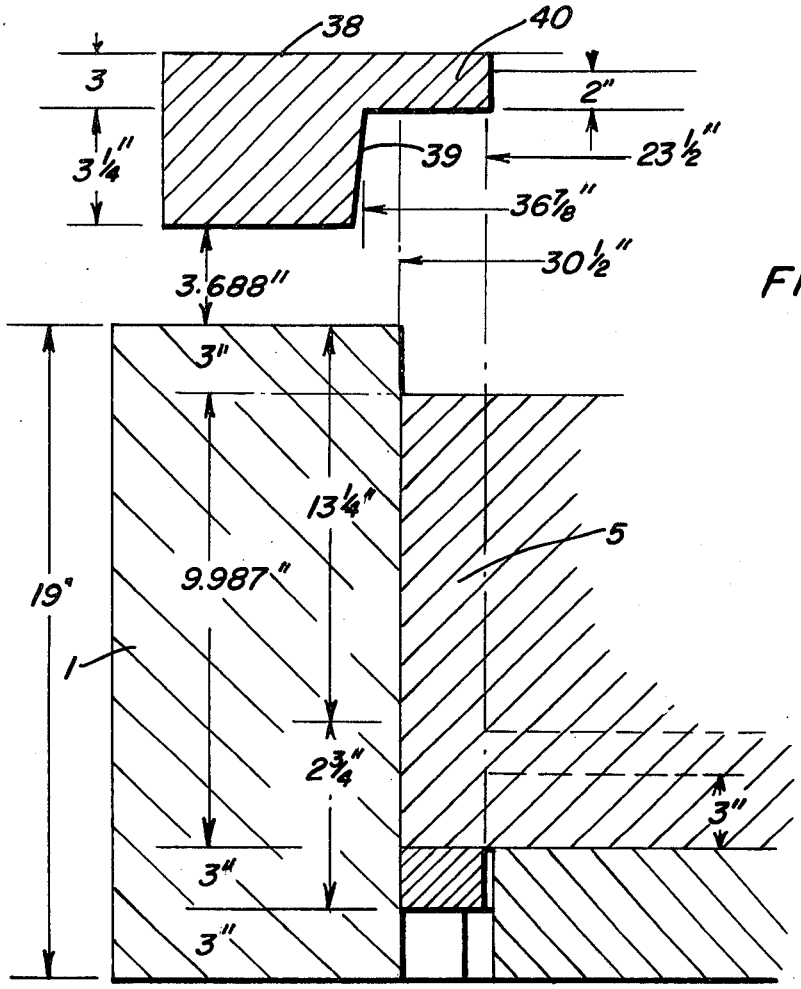
FIGS. 7 and 8 are single fragmentary sectional elevational views taken from the left-hand side of the female forging die and illustrating the continuance of the process to the point where the annular male bolt flange is about to be formed, and the process completed.

The top of the male bolting flange die 38 and the deep periphery and bottom surface thereof, are flat, as shown in FIG. 7. However, the inner wall 39 which connects the deep periphery with the central relatively narrow flange portion 40 is inwardly flared.

As shown, the top of the cylindrical female forging die member 1 and that portion on the underside of the male bolting flange die 38 which is immediately opposite and which ultimately makes contact therewith are flat.

Figure 8:
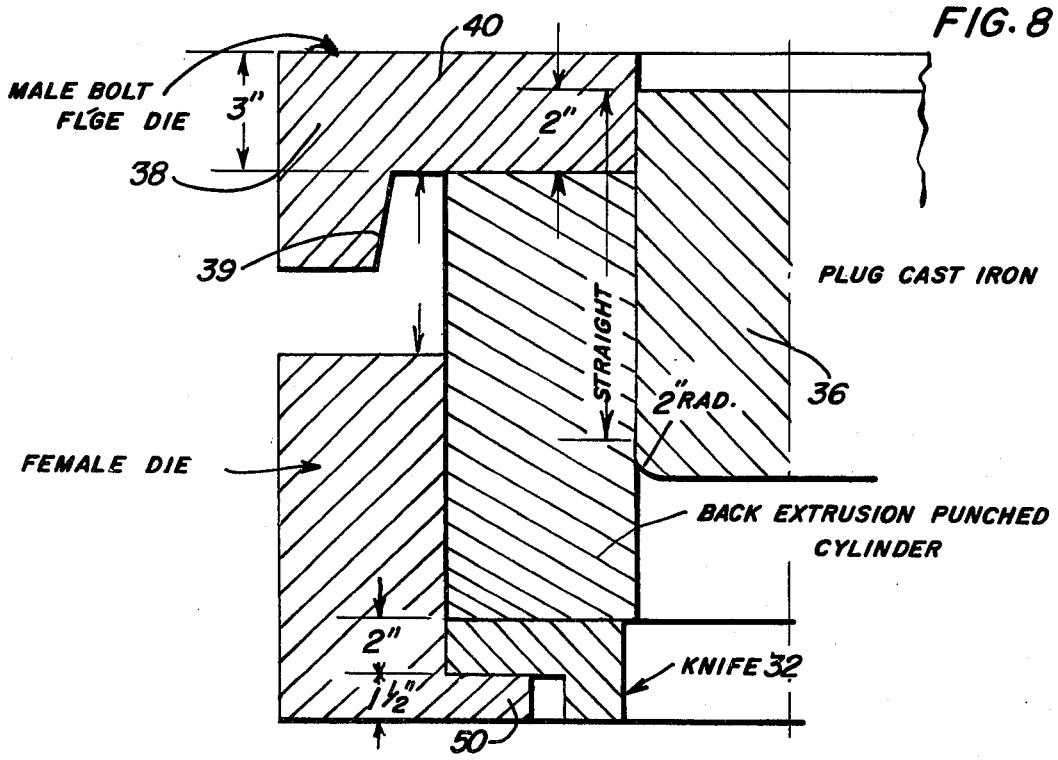

The position of the top of the now cylindrical work-piece 5 immediately prior to the application of downward forging pressure thereonto is represented in FIG. 8.

From the foregoing explanation it is believed clear that the shapes of the forging instrumentalities operated in the manner described will result in the formation of a welding neck of the general configuration of the product illustrated in FIG. 1.

The dimensions in FIGS. 7 and 8 are representative of the size of the forging instrumentalities which are employed in the present process in order to obtain a welding neck of 24 inches × 300 lbs. Series Type H Neck of 16-inch height.

In this particular instance of a desired end product of 24 inches × 300 lbs. Series Type H Neck ×16 inches in height, the starting solid work-piece was 9.987 long ×30.5 inches in diameter which weighed only 2,044 lbs. as compared with a required solid work-piece weight of 3,725 lbs. if the conventional prior art method of obtaining the same final product weight had been practiced. The reason for this difference is due to the saving gained by back extrusion when it is necessary to punch out a 3 inch thick disc whereas in the old method it was necessary to punch out the entire 16 inches of height.

The metal-working and metal-displacing disc 11 is of a diameter which is between 23 inches and 23.5 inches. The degree of back-extrusion effected by the metal-working and metal-displacing disc 11 with the aid of the second round forging press follower 24, is represented in dotted lines in FIG. 7; and is 9.987 inches plus 3 inches plus 3.68 inches plus 3.25, inches or a total of 19.925 inches.

At the conclusion of the back-extrusion process the block is removed from the bottom of the cylindrical female forging die member; and with the aid of the metal-working and metal-displacing disc 11 and the (second) round forging press follower 24 and the downwardly movable platen of the forging press, the bottom 3 inch thick metal 28 is punched out along with the metal-working and metal-displacing disc 11.

At this point the work-piece is entirely cylindrical and is approximately 19.925 inches long.

The next step would be to place the 2.75 inch block 34 in the cylindrical female forging die member on top of the circular knife 32; in order to adjust the desired height of 12.25 inches of length of the desired back of the underside of the male bolt flange recess.

Figure 5:
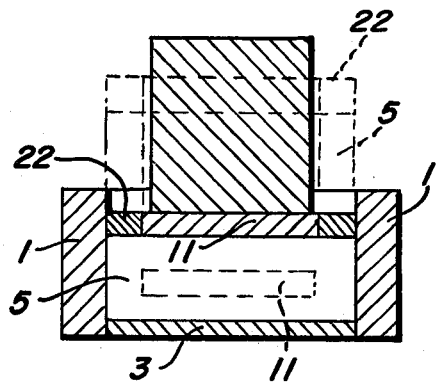

The now-cylindrical work-piece 5 at forging temperature—reheated if necessary—-being in place in the die cavity, a cast iron plug 36 (see FIG. 5) is approximately 15 inches in length is inserted in the top of the cylindrical work-piece to a point where approximately 2 inches thereof protrudes above the level of the upper end of the work-piece and serves as a centering device for the annular male bolt flange 38. With a single push of the round forging press follower the cast iron plug is pressed down into the interior of the top of the cylindrical work-piece 5 for a distance of approximately 3.688 inches.

This upset of the top portion of the extrusion will move outwardly, thus forming the male bolt flange of desired thickness and diameter.

The cast iron plug 36 prevents the movement of the metal of the back-extruded work-piece 5 inwardly or toward the bore of the cylindrical female forging die member.

The final step of the forging operation is to push the cast iron plug 36 downwardly and completely through the bottom of the cylindrical female forging die member 1 which now carries the completely formed welding neck; and which now can be readily removed therefrom.

As indicated earlier herein, the process of the present invention provides for the application of any male bolt flange on any cylinder desired. For example, a 20 inch × 300 lbs. Series welding neck has a wall thickness of only 1.5 inches. and this may not be enough to reinforce a certain pressure vessel. With the present process a 20 inch ×300 lbs. Series male bolt flange may be formed on the wall of a cylinder with a wall-thickness of 2.75 inches, thus giving much more reinforcement where needed.

The main reason for leaving a 3 inch thickness at the bottom of the cylindrical female forging die member 1 during the back-extruding step is that as metal from the inside of the work-piece 5 is being displaced it must move to the outside, turn and then move upwardly, thus causing back-extrusion.

There must be provision for turning, and reverse direction of the hot metal being forged; and probably 3 inches in thickness is minimum in most instances.

This punched-out slug 28 of metal of 3 inches thickness makes a flat disc of the following weights for the sizes oppositely indicated and in carbon steel:

| Neck Size | Weight in Pounds |
|---|---|
| 14" | 122 |
| 16" | 182 |
| 18" | 204 |
| 20" | 254 |
| 24" | 369 |

and the teachings of the invention contemplate special use therefor.

In manhole-size welding necks, i.e., 14 inches and above, there is a product known as a Blind Flange; and each welding neck of the manhole size requires a Blind Flange prior to installation of the welding neck. These products are simply a disc or solid cover, as earlier indicated.

At present 3 inch thick discs resulting from making a cylinder from cup-shaped work-pieces are thrown away; or used simply as scrap.

By increasing the weight of the initial work-piece the present process permits the punching-out of slugs 28 (see FIG. 6) of sufficient weight to permit their being spread out into a Blind Flange which corresponds to the size of the cylindrical work-piece after the punching-out step.

Such Blind Flanges could be offered to the industry as a sort of bonus, or partial bonus, for those who are purchasing the large size welding necks.

Having thus described the invention what I claim as new and desire to secure as Letters Patent is:

1. A process for forging large heavy-duty seamless, high-pressure resistant, self-reinforcing ferrous-metal open-ended welding necks and the like having walls of substantial thickness in a forging press possessing the usual lower stationary element and the usual upper vertically movable element, said process including a. placing on the lower stationary element of the forging press a vertically disposed cylindrical female forging die member provided at the bottom thereof with a removable metallic disc and a peripherally enclosing circular forging knife b. placing within the vertically disposed cylindrical female forging die member, and atop the removable metallic disc and peripherally enclosing circular forging knife, a steel billet heated to forging temperature c. placing on top of the heated steel billet an annular billet-contacting metal-working and metal-displacing ring having an external diameter which is less than the diameter of the bore of the cylindrical female forging die member d. positioning within the opening of the annular billet-contacting metal-working and metal-displacing annular ring a billet-contacting metal-working and metal-displacing metallic disc which is fairly closely fitting and of substantially the same thickness as that of the annular billet-contacting metal-working and metal-displacing ring e. disposing atop the annular metallic billet-contacting metal-working and metal-displacing ring and the metal-working and metal-displacing metallic disc a round forging press follower of a diameter which is less than the diameter of the die cavity of the cylindrical female forging die member but sufficient to cover both the metallic billet-contacting metal-working and metal-displacing metallic disc and most of the metallic billte-contacting metal-working and metal-displacing annular ring f. moving the upper and vertically movable element of the forging press downwardly to thereby press the round forging press follower onto the annular billt-contacting metal-working and metal-displacing metallic disc and the billet-contacting metal-working and metal-displacing annular ring and, through said metallic disc and said annular ring, exert forging pressure onto the top of the heated billet, whereby the billet spreads out until the outer periphery thereof makes contact with the inner surface of the die cavity of the cylindrical female forging die member g. arresting the downward movement of the upper and vertically movable element of the forging press when the immediately aforementioned condition takes place h. removing the aforementioned round forging press follower and replacing it with a second round forging press follower having a diameter that is less than that of the billet-contacting metal-working and metal-displacing disc and which is concentric therewith i. applying pressure through the upper and vertically movable element of the forging press to the top of the second-named round forging press follower, whereupon the latter depresses the billet-contacting metal-working and metal-displacing metallic disc, and the metal of the heated billet is caused to move upwardly into the space between the periphery of the billet-contacting metal-working and metal-displacing metallic disc and the inner surface of the die cavity of the cylindrical forging die member during which the annular billet-contacting metal-working and metal-displacing annular ring moves upwardly on top of the back-extruded metal j. continuing the immediately aforementioned movements until the metal of the heated work-piece below the metal-working and metal-displacing metallic disc is no less than approximately three inches thick k. removing the annular metal-working and metal-displacing annular ring from the top of the back-extruded work-piece formed of said heated billet l. removing the removable disc from the bottom of the vertically disposed cylindrical female forging die member and m. punching-out the aforementioned three-inch thickness of metal at the bottom of the work-piece and the billet-contacting metal-working and metal-displacing metallic disc through the hereinbefore described circular forging knife and out of the vertically disposed cylindrical female forging die member.

2. The process of claim 1 wherein the circular forging knife is not introduced until the removable disc is removed from the bottom of the cylindrical forging die member.

3. The process of claim 1 wherein the circular forging knife surrounds the removable disc at the bottom of the cylindrical female forging die member.

* * * * *